US007131285B2

(12) United States Patent
Lifson et al.

(10) Patent No.: US 7,131,285 B2
(45) Date of Patent: Nov. 7, 2006

(54) REFRIGERANT CYCLE WITH PLURAL CONDENSERS RECEIVING REFRIGERANT AT DIFFERENT PRESSURE

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 267 days.

(21) Appl. No.: 10/963,484

(22) Filed: Oct. 12, 2004

(65) Prior Publication Data

US 2006/0075768 A1 Apr. 13, 2006

(51) Int. Cl.

| | |
|---|---|
| ***F25B 41/00*** | (2006.01) |
| ***F25B 49/00*** | (2006.01) |
| ***F25B 1/10*** | (2006.01) |
| ***F04B 3/00*** | (2006.01) |

(52) U.S. Cl. ..... 62/196.4; 62/510; 417/251

(58) Field of Classification Search ..... 62/175, 62/196.4, 197, 510; 417/251, 252
See application file for complete search history.

(56) References Cited

U.S. PATENT DOCUMENTS 6,748,754 B1 * 6/2004 Matsumoto et al. ..... 62/175
7,000,424 B1 * 2/2006 Matsumoto et al. ..... 62/324.6

* cited by examiner

*Primary Examiner*—Marc Norman
(74) *Attorney, Agent, or Firm*—Carlson, Gaskey & Olds

(57) ABSTRACT

A refrigerant cycle is provided with a compressor system, capable of simultaneously delivering refrigerant to multiple condensers operating at different temperature levels. A single evaporator communicates with these condensers. One of the condensers receives fully compressed refrigerant while the others receives refrigerant at an intermediate pressure. A control can optionally direct refrigerant to only one of these condensers to achieve desired heat rejection and other operational characteristics. Various system configurations with multiple compressors and condensers are also disclosed.

16 Claims, 2 Drawing Sheets

REFRIGERANT CYCLE WITH PLURAL CONDENSERS RECEIVING REFRIGERANT AT DIFFERENT PRESSURE

BACKGROUND OF THE INVENTION

This application relates to a refrigerant cycle having a common evaporator, but separate condensers, where one of the condensers is connected to an intermediate pressure compression stage, while the other condenser is connected to the high pressure compression stage.

Refrigerant cycles are utilized in applications to change the temperature and humidity or otherwise condition the environment. In a standard refrigerant system, a compressor delivers a compressed refrigerant to a heat exchanger, known as a condenser, which is typically located outside. From the condenser, the refrigerant passes through an expansion device, and then to an indoor heat exchanger known as an evaporator. At the evaporator, moisture may be removed from the air, and the temperature of air blown over the evaporator coil is lowered. From the evaporator, the refrigerant returns to the compressor. Of course, basic refrigerant cycles are utilized in combination with many configuration variations and optional features. However, the above provides a brief understanding of the fundamental concept.

Refrigerant cycles are known, wherein a so-called economizer circuit is incorporated. In an economizer circuit, a first refrigerant line is tapped from a main refrigerant line downstream of the condenser. The tapped refrigerant line is passed through an expansion device, and then the tapped refrigerant and the main refrigerant both flow through an economizer heat exchanger. The tapped refrigerant subcools the main refrigerant, such that when the main refrigerant reaches an evaporator, it will have a greater cooling potential. The tapped refrigerant, having subcooled the main refrigerant, is returned to the compressor at an intermediate compression point.

The present invention redirects the flow of refrigerant from an intermediate compression point in a compressor to selectively provide refrigerant to at least one of a plurality of condensers, where each of the condensers operate at different temperature levels. In this manner, the heat rejection characteristics of the refrigerant cycle can be controlled to provide a variety of options to a refrigerant cycle designer and to satisfy a wide spectrum of applications.

SUMMARY OF THE INVENTION

In the proposed system design, a portion of the refrigerant, compressed to some intermediate pressure, leaves a compressor at an intermediate port, while the rest of the refrigerant vapor continues through the compression process to a main discharge port and then to a first (main) condenser. The refrigerant that leaves the intermediate discharge port is connected to another (second) condenser. Consequently, for this system an additional temperature level of heat rejection is available. Such heat rejection capability at various temperature levels can be utilized in multiple industry applications where condensers are located within different environments. For example, for cooling applications, where the evaporator is located indoors, the main condenser can be located outdoors, while the second condenser is located indoors. Another application would be for heat pump heating installations, where there are two environmental chambers each requiring a different amount of heating. In this case, one chamber will be heated by air passing over first condenser, while the other chamber will be heated by air passing over the other condenser. The amount of refrigerant flowing through each condenser can be regulated by the respective expansion devices, as explained below. In the present invention, a refrigerant cycle is provided with a common evaporator receiving refrigerant from at least two condensers.

In several embodiments, there may be more than one compressor connected in series, or a single compressor with the intermediate compression ports can selectively deliver refrigerant to at least two condensers. Also, multiple compressors may be connected in banks to provide more flexibility in the refrigerant flow control and system performance. Moreover, a compressor can have several intermediate compression ports, each connected to a separate condenser.

These and other features of the present invention can be best understood from the following specification and drawings, the following of which is a brief description.

DETAILED DESCRIPTION OF THE PREFERRED EMBODIMENT

Figure 1:
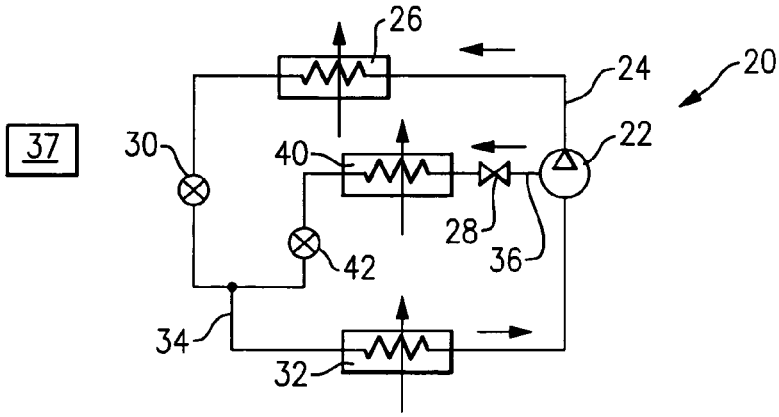
FIG. 1 is a first schematic.

FIG. 1 shows a refrigerant cycle 20 having a single compressor 22 delivering compressed refrigerant to a discharge line 24. Discharge line 24 communicates with a first condenser 26. Refrigerant passes through the condenser 26 and then to an expansion device 30. At connection 34, refrigerant is received downstream of the expansion device 30, and delivered to an evaporator 32. The refrigerant from the evaporator 32 returns to the compressor 22. An intermediate pressure tap line 36 passes through an optional shut-off valve 28, and delivers a refrigerant vapor compressed to an intermediate pressure level (between suction pressure and discharge pressure) to a second condenser 40. The shut-off valve 28 can be closed if under some operating conditions there is a need to route all of the refrigerant entering the compressor 22 through a discharge line 24. Otherwise, the shut-off valve 24 would normally be open. An expansion device 42 is positioned downstream of condenser 40. The refrigerant in the condensers 40 and 26 would be at a distinct temperature and pressure. The two condensers can be utilized to provide more effective control over the overall operation of the refrigerant cycle. As mentioned above, there would be reasons why a worker of ordinary skill in the art would want to have greater control over the heat rejection characteristics of the refrigerant cycle 20. This two-condenser system provides greater system control and flexibility as well as covers an extended range of various applications. It should also be obvious to a worker of ordinary skill in the art to extend this arrangement to a compressor that will have several staged intermediate ports, as described in U.S. Pat. No. 6,694,750. In this case, each of those intermediate ports can be connected to a separate condenser.

A control 37 controls the various devices and components in the refrigerant cycle 30 to achieve the desired characteristics.

Figure 2:
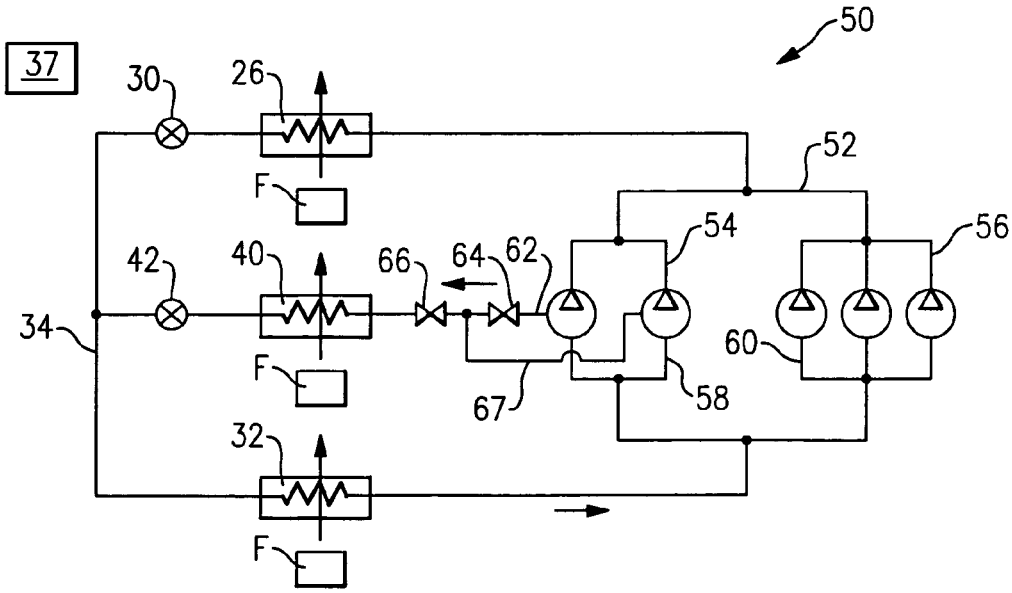
FIG. 2 is a second schematic.

FIG. 2 shows a more complicated refrigerant cycle 50. As shown, a discharge manifold 52 is positioned to be downstream of a first compressor bank 54 and a second compressor bank 56. As should be understood, the compressor banks 54 and 56 are each tandem compressors that receive refrigerant from a common evaporator 32 and deliver the refrigerant to a common condenser 26.

The refrigerant downstream of the condenser 26 passes through an expansion device 30, into a line 34, and then to the evaporator 32, as in the previous embodiment.

A tap line 62 from an intermediate compression point associated with one of the compressors in the bank 54 passes refrigerant through an optional shut-off valve 64, and through an optional shut-off valve 66, to a second condenser 40. An expansion device 42 is positioned downstream of the condenser 40. A second tap line 67 taps refrigerant from a second of the compressors in the compressor bank 54, again at an intermediate pressure. The shut-off valves 28, 64 and 66, as explained above, would block the flow from the compressor banks to each of the condensers 26 and 40. The location of the shut-off valves is provided for illustration purpose, as other locations are possible as long as they provide a function of blocking the flow out of the intermediate compression ports.

The refrigerant cycle 50 operates in a similar fashion as a refrigerant cycle 20. Refrigerant is tapped to the condenser 40 when heat rejection at a lower temperature is desired. Thus, a designer is provided with the options of greater control over the heat rejection characteristics and overall operation of the refrigerant cycle 50.

Figure 3:
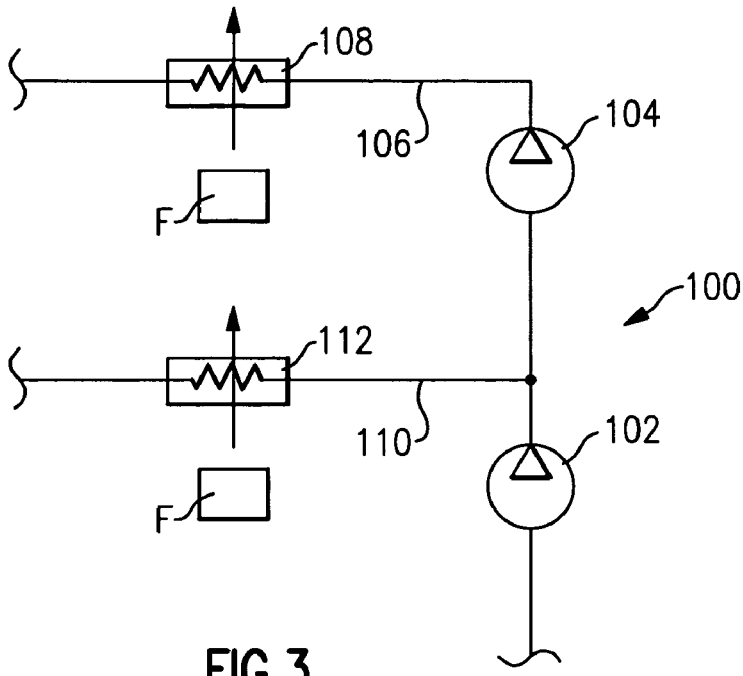
FIG. 3 is a third schematic.

FIG. 3 shows yet another schematic 100, wherein there are serially connected compressors 102 and 104. A tap 106 downstream of the second stage compressor 104 delivers refrigerant to a condenser 108. A tap 110 downstream of the first stage compressor 102 delivers refrigerant to another condenser 112. For purposes of this application, this embodiment 100 would be delivering a refrigerant at an "intermediate" pressure (tap 106) to the condenser 112.

Figure 4:
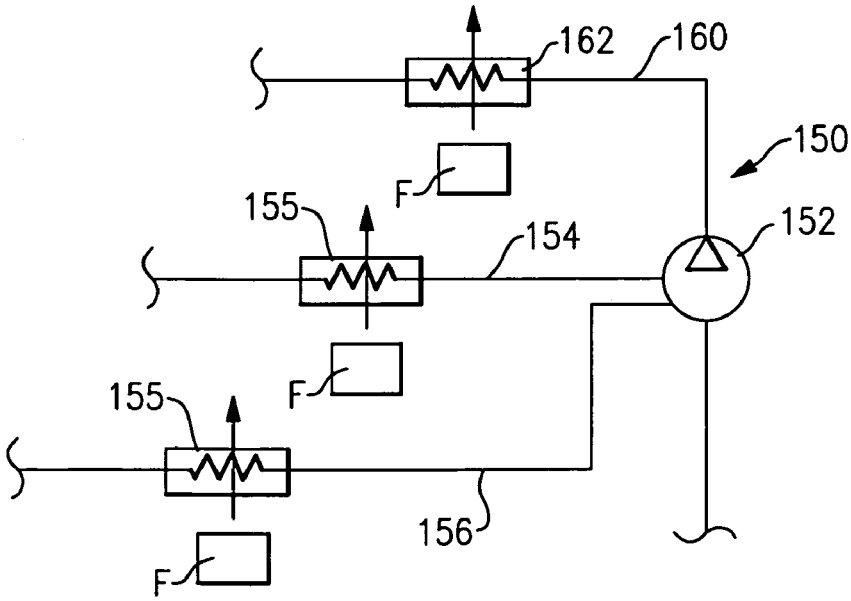
FIG. 4 is a fourth schematic.

FIG. 4 shows an embodiment 150, having a compressor 152, such as mentioned above, wherein there are plural intermediate taps 154 and 156. Each of these intermediate taps selectively delivers a refrigerant to one of the condensers 155. As shown, the discharge line 160 leads to its own condenser 162. Thus, the embodiment 150 has three condensers. Of course, more condensers operating at different temperature levels can be utilized as desired.

Furthermore, other multiples of compressors and compressor banks can be utilized within the scope of this invention. As known in the art, multiple tandem compressors provide more flexibility in the refrigerant flow control and system performance characteristics.

Obviously, more than two or three condensers may be utilized within a single system to allow heat rejection at more than two or three temperature levels. Furthermore, these condensers can be supplied with the refrigerant by a compression system with either multiple intermediate compression ports or multiple compressors connected in series.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising:

at least one compressor delivering a refrigerant to a first condenser from a discharge line, refrigerant from said first condenser passing through an expansion device, and downstream to an evaporator, refrigerant from said evaporator returning to said compressor; and an intermediate pressure tap for tapping refrigerant from said compressor at an intermediate compression point, refrigerant from said intermediate pressure tap passing through a second condenser, refrigerant having passed through said second condenser passing through an expansion device and to said evaporator, and from said evaporator back to said compressor.

2. The refrigerant cycle as set forth in claim 1, wherein a single compressor delivers refrigerant to said discharge line and to said intermediate pressure tap.

3. The refrigerant cycle as set forth in claim 1, wherein a control selectively controls a delivery of refrigerant from said at least one compressor to each of said first and second condensers.

4. The refrigerant cycle as set forth in claim 1, wherein said at least one compressor is a plurality of compressors.

5. The refrigerant cycle as set forth in claim 4, wherein at least one of said plurality of compressors is not delivering refrigerant to said second condenser.

6. The refrigerant cycle as set forth in claim 5, wherein there are a plurality of compressor banks, with at least one of said compressor banks not delivering refrigerant to said second condenser.

7. The refrigerant cycle as set forth in claim 1, wherein there are more than two condensers.

8. The refrigerant cycle as set forth in claim 1, wherein said at least one compressor is at least two compressors connected in series, and wherein said intermediate pressure tap is upstream of a downstream one of said at least two compressors.

9. The refrigerant cycle as set forth in claim 8, wherein said intermediate pressure tap is selected to be downstream of an upstream one of said at least two compressors.

10. The refrigerant cycle as set forth in claim 1, wherein said at least one compressor has several intermediate ports at different intermediate pressures, each connected to a separate condenser.

11. A method of operating a refrigerant cycle comprising the steps of:

1) providing at least one compressor, said at least one compressor having a discharge line for delivering a compressed refrigerant to a first condenser, and said at least one compressor having an intermediate pressure tap for delivering a partially compressed refrigerant to a second condenser, refrigerant from both first and second condensers passing through a common evaporator and back to at least said one compressor;

2) operating said refrigerant cycle by selectively routing refrigerant from said at least one compressor to said first and second condensers to achieve desired heat rejection characteristics.

12. The method as set forth in claim 11, wherein said at least one compressor includes a plurality of compressors.

13. The method as set forth in claim 11, wherein there are more than two condensers.

14. The method as set forth in claim 11, wherein said at least one compressor has several intermediate ports at different intermediate pressures, each connected to a separate condenser.

15. The method as set forth in claim 11, wherein said at least one compressor is at least two compressors connected in series, and wherein said intermediate pressure tap is upstream of a downstream one of said at least two compressors.

16. The method as set forth in claim 15, wherein said intermediate pressure tap is selected to be downstream of an upstream one of said at least two compressors.

* * * * *